United States Patent [19]

Parrish

[11] 4,139,047

[45] Feb. 13, 1979

[54] INDUCTOR FOR ELECTROMAGNETIC CASTING

[75] Inventor: Robert M. Parrish, Richmond, Va.

[73] Assignee: Reynolds Metals Company, Richmond, Va.

[21] Appl. No.: 816,466

[22] Filed: Jul. 18, 1977

[51] Int. Cl.[2] ..... B22D 27/02

[52] U.S. Cl. ..... 164/147; 164/250; 164/443

[58] Field of Search ..... 164/147, 49, 251, 441, 164/442, 443, 444, 250

[56] References Cited

U.S. PATENT DOCUMENTS

| | | | |
|---|---|---|---|
| 3,605,865 | 9/1971 | Getselev | 164/147 X |
| 3,773,101 | 11/1973 | Getselev | 164/147 |
| 4,004,631 | 1/1977 | Goodrich et al. | 164/250 |

FOREIGN PATENT DOCUMENTS

| | | | |
|---|---|---|---|
| 5027807 | 4/1966 | Japan | 164/147 |
| 508332 | 5/1976 | U.S.S.R. | 164/147 |

*Primary Examiner*—Robert L. Spicer, Jr.
*Attorney, Agent, or Firm*—Glenn, Lyne, Girard, Clark & McDonald

[57] ABSTRACT

A solid inductor for forming an inner wall of a coolant box for an electromagnetic continuous casting system has a deflector integrally formed on the exterior surface thereof to deflect coolant passing through passages in the solid inductor. In one embodiment, the deflector is formed by an indentation on the exterior surface of the deflector, and in another embodiment, it is formed by a protrusion on the exterior surface of the solid inductor.

16 Claims, 5 Drawing Figures

INDUCTOR FOR ELECTROMAGNETIC CASTING

BACKGROUND OF THE INVENTION

This invention relates broadly to the art of electromagnetic continuous casting systems and more specifically to solid inductors having spray passages therethrough forming walls of coolant boxes for such systems.

U.S. Pat. Nos. 3,985,179 and 4,004,631 to Goodrich and John describe electromagnetic continuous casting systems wherein solid inductors form the inner walls of coolant boxes. In these patents, the solid inductors have passages through which coolant is sprayed from the coolant boxes onto ingots being cast.

In this respect, in conventional DC casting systems, exterior surfaces of ingots being cast are shaped by molds which cool and freeze molten metal into ingots. A disadvantage in such systems is that the exterior surfaces thereof are somewhat rough and must often be "scalped" after molding. In electromagnetic casting, on the other hand, molten metal is held in a shape by an electromagnetic field created by a solid inductor which encircles molten metal. While the molten metal is thusly shaped, coolant, such as water, is sprayed onto the outer surface of the molten metal to freeze it. Such a system is advantageous over a normal DC casting system in that it creates a smoother surface and scalping can often be avoided therewith. It has been found, however, that uniformity of the coolant spray can affect the smoothness of the exterior surface of an ingot casted by such an electromagnetic continuous casting system. In this regard, fine passages through a solid inductor, as are disclosed in the above-mentioned Goodrich patents often clog, or otherwise become restricted, and therefore do not provide a sufficiently uniform flow. Thus, it is an object of this invention to provide a water-through-inductor electromagnetic continous casting system which provides a more uniform flow than similar systems in the prior art, and which is not so sensitive to blockage in passages.

It is a further object of this invention to provide a solid inductor to be used with a coolant box of an electromagnetic continuous casting system which provides a uniform flow without requiring additional baffles, deflectors, and the like.

It is yet a further object of this invention to provide a coolant box for use with an electromagnetic casting system which is uncomplicated in structure yet which provides uniform spray on ingots without requiring additional elements depending from the coolant box or other associated structure.

SUMMARY OF THE INVENTION

According to principles of this invention, a solid inductor forming the inner wall of an electromagnetic-casting-system coolant box has a deflector integral therewith. The deflector can be formed by a protrusion formed on the inductor or by an indentation in the inductor. Normally, a deflector surface is positioned tangential to (or coplanar with) the flow of coolant exiting from passages through the inductor.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
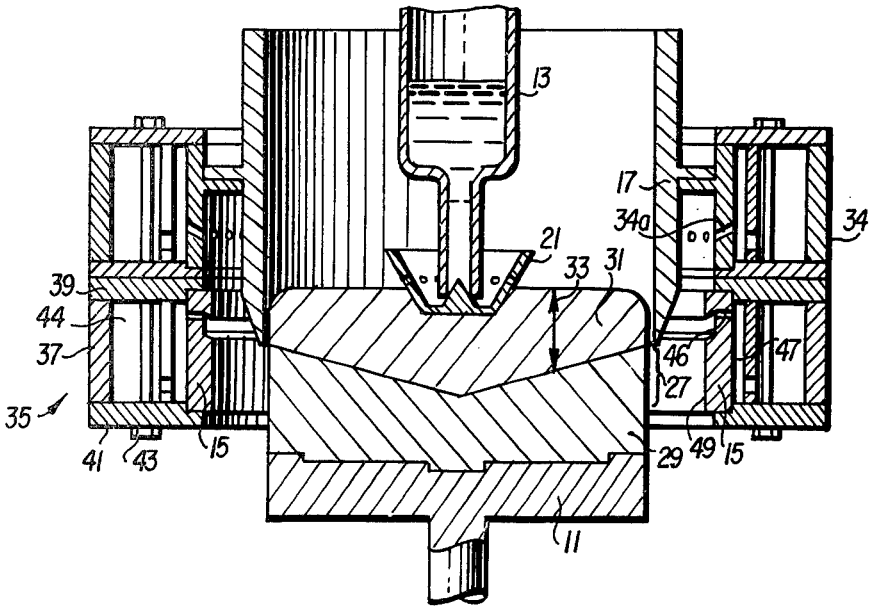
FIG. 1 is a sectional view of an electromagnetic continuous casting molding apparatus having a coolant box, and solid inductor as part thereof, employing principles of this invention.

Referring first to FIG. 1, an electromagnetic continuous molding apparatus includes a movable bottom block or pan 11, a supply spout 13 controlled by a float or other means, a solid inductor 15, and an electromagnetic shield 17. In overall operation, molten metal flows from the supply spout 13 via a float valve 21 onto the bottom block or pan 11. The molten metal is maintained in an appropriately-shaped column by electromagnetic and electrostatic forces created by alternating current in the solid inductor 15. Coolant, such as water is sprayed onto the molten metal at an impingement zone 27 to solidify some of the metal into a shell 29 but to leave the molten metal above the shell 29 in a wall or "melt" 31 having a head 33. In this manner the ingot is continuously molded. Coolant boxes 34 and 35 respectively provide coolant for cooling the electromagnetic shield 17 and the shell 29. The coolant box 34 sprays through shield-spray passages 34*a* onto the shield 17.

This invention concerns the solid inductor 15 which forms the inner wall of a coolant box 35. The coolant box 35 further includes an outer wall 37, and upper and lower walls 39 and 41. The upper and lower walls 39 and 41 are clamped onto the outer wall 37 and the solid inductor 15 by bolts 43. Appropriate seals and packing are included to make a cavity 44 water tight except for an inlet thereto (not shown) and ingot-spray passages 46. The ingot-spray passages 46 each extend from an interior (inside the coolant box 35) surface 47 of the solid inductor 15 to the external (outside the coolant box 35) surface 49 thereof. These passages 46 are arranged in a line extending about the solid inductor 15 and lie in a plane perpendicular to the ingot being cast.

Figure 2:
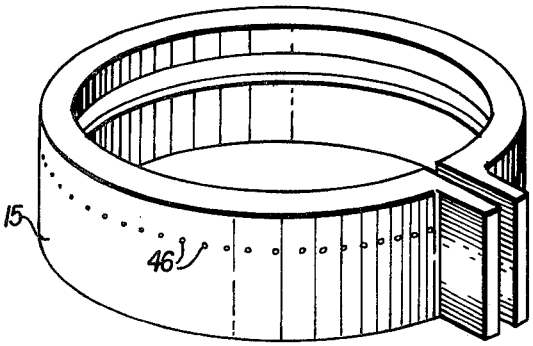
FIG. 2 is an isometric view of the solid inductor of FIG. 1.
Figure 3:
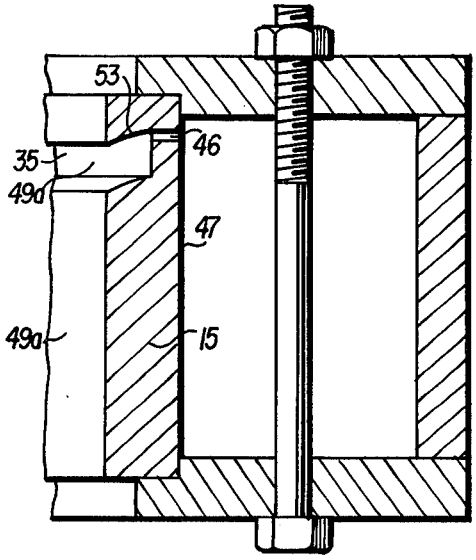
FIG. 3 is a sectional view of the coolant box of FIG. 1.

In the FIGS. 1–3 embodiment of this invention, the external surface 49 of the solid inductor 15 has an indented shape to form a continuous curved deflector surface 51 for engaging coolant exiting from the ingot-spray passages 46 and directing the flow of this coolant. In this respect, the deflector surface 51 is curved with its upstream end 53 being substantially tangential, or coplanar, to the flow of coolant coming from the ingot-spray passages 46; however, the deflector surface 53 curves downwardly therefrom, in the downstream direction, to direct the flow of coolant below the electromagnetic shield 17 onto the ingot.

Figure 4:
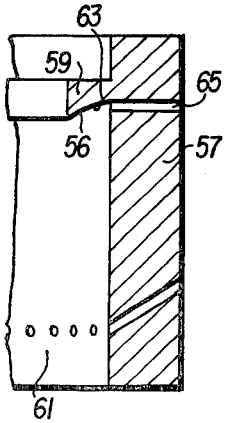
FIG. 4 is a sectional view of a second embodiment solid inductor employing principles of this invention.

In the FIGS. 1–3 embodiment, the deflector surface 51 is formed on the external surface 49 of the solid inductor 15 by indenting the external surface thereof from a main portion 49a to an indented portion 49b and using the upper surface of the indented portion 49b as the deflector surface 51. However, it is also possible to form a deflector surface on a solid inductor 57 (FIG. 4) by means of a protrusion 59 on the external surface 61 as is shown in FIG. 4. Again, the upstream end 63 of the deflector surface 56 is tangential to, or coplanar with, flow of coolant from passageways 65.

Figure 5:
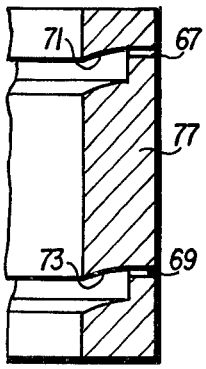
FIG. 5 is a sectional view of a third-embodiment solid inductor employing principles of this invention.

In another embodiment, as is depicted in FIG. 5, there are two sets of passages 67 and 69 and two continuous deflector surfaces 71 and 73 formed on an exterior surface 75 of a solid inductor 77 which forms the inner wall of a coolant box (not shown).

It will be appreciated by those skilled in the art, that the solid inductors having integral deflector surfaces described herein tend to flatten out liquid coolant exiting from the passages 45, 65, and 67, to thereby spray the coolant in sheets onto ingots being cast. Such sheets of fluid coolant form uniform impingement on the ingots, thereby producing ingots having superior surface smoothness. It is noted that this is accomplished without the necessity of having separately dependent baffles and deflectors as was necessary in the prior art. Also, it is noted that the clogging of individual passages 65 does not affect the uniformity with which the coolant is sprayed onto the ingot to the degree it did in prior-art water-through-the-inductor systems.

While this invention has been particularly shown and described with reference to preferred embodiments, it will be understood by those skilled in the art that various changes in form and detail may be made therein without departing from the spirit and scope of the invention. For example, dual inductors forming walls of water boxes, one above the other, could be used, each having integral deflectors with the inductors for deflecting water passing through passages through the inductors. Also, the passages 46, 65, and 67 could be oriented at various attitudes and angles and have various cross-sectional sizes. Further, it is possible to use the integral-deflector inductors of this invention without a shield 17 under certain circumstances.

I claim

1. A loop-shaped coolant box for an electromagnetic continuous casting system for transporting coolant around, and spraying coolant onto an ingot being cast, said coolant box including an inner wall formed of an electromagnetic solid inductor, said solid inductor having passages therethrough for allowing coolant in said coolant box to pass from the interior of the coolant box through said solid inductor to the exterior surface of said inductor and be sprayed onto said ingot, said solid inductor further including an integral portion thereof forming a continuous deflector surface on the exterior surface of said inductor for engaging and deflecting coolant exiting from said passages.

2. A loop-shaped coolant box as in claim 1 wherein said passages are situated in a line extending about said loop-shaped coolant box in a plane perpendicular to a continuous ingot being cast.

3. A coolant box as in claim 2 wherein said deflector surface is continuous about said loop-shaped coolant box and its upstream end is approximately coplanar to the direction of travel of coolant exiting from said passages, but its downstream end curves across the flow of said coolant to flatten out said coolant and cause said coolant to form a sheet upon leaving said deflector surface.

4. A coolant box as in claim 3 wherein said deflector surface is formed on a protruding portion of said solid inductor which protrudes outwardly from a main exterior surface of said solid inductor.

5. A coolant box as in claim 3 wherein said deflector surface is formed on an indented portion of said exterior surface which is indented from a main exterior surface of said solid inductor.

6. A coolant box as in claim 3 wherein there are two lines of passages and two deflectors.

7. Apparatus for continuously casting an elongated ingot comprising:

a molten-metal supply means for continuously supplying molten metal to a first end of said ingot at a casting station;

a means for moving a second end of said ingot away from the supply means; and an electromagnetic-inductor assembly including a solid electromagnetic inductor positioned at said casting station for producing an electromagnetic field at said molten metal to generate forces in said molten metal, said electromagnetic inductor assembly including further coolant-box walls attached to said solid inductor to form a coolant box with said solid inductor, said solid inductor forming a wall thereof adjacent to said molten-metal at said casting station, said solid inductor having passages therethrough for allowing coolant in said coolant box to pass from the interior of said coolant box, through said solid inductor to the exterior surface of said inductor and be sprayed onto said ingot, said solid inductor further including an integral portion thereof forming a continuous deflector surface on the exterior surface of said inductor for deflecting coolant sprayed from said passages.

8. Apparatus as in claim 7 wherein said passages are situated in a line extending about said coolant box in a plane perpendicular to a continuous ingot being cast.

9. Apparatus as in claim 8 wherein said deflector surface is continuous about said loop-shaped coolant box and its upstream end is approximately coplanar to the direction of travel of coolant exiting from said passages, but its downstream end curves across the flow of said coolant to flatten out said coolant and cause said coolant to form a sheet upon leaving said deflector.

10. Apparatus as in claim 9 wherein said deflector surface is formed on a protruding portion of said solid inductor which protrudes outwardly from a main exterior surface of said solid inductor.

11. Apparatus as in claim 9 wherein said deflector surface is formed on an indented portion of said exterior surface which is indented from a main exterior surface of said solid inductor.

12. A solid inductor for use as an inner wall of a loop-shaped coolant box of an electromagnetic continuous casting system, said solid inductor having passages therethrough for allowing coolant in said coolant box to pass from the interior of said coolant box, through said solid inductor to the exterior surface of said inductor and be sprayed onto said ingot, said solid inductor further including an integral portion thereof forming a continuous deflector on the exterior surface of said inductor for deflecting coolant exiting from said passages.

13. A solid inductor as in claim 12 wherein said passages are situated in a line extending about said loop-shaped coolant box in a plane perpendicular to a continuous ingot being cast.

14. A solid inductor as in claim 13 wherein said deflector surface is continuous about said loop-shaped coolant box and its upstream end is approximately coplanar to the direction of travel of coolant exiting from said passages, but its downstream end curves across the flow of said coolant to flatten out said coolant and cause said coolant to form a sheet upon leaving said deflector.

15. A solid inductor as in claim 14 wherein said deflector surface is formed on a protruding portion of said solid inductor which protrudes outwardly from a main exterior surface of said solid inductor.

16. A solid inductor as in claim 14 wherein said deflector surface is formed on an indented portion of said exterior surface which is indented from a main exterior surface of said solid inductor.

* * * * *